US008302665B2

(12) United States Patent
Jeong et al.

(10) Patent No.: US 8,302,665 B2
(45) Date of Patent: Nov. 6, 2012

(54) CASTING ROLL OF TWIN ROLL TYPE STRIP CASTER AND SURFACE TREATMENT METHOD THEREOF

(75) Inventors: Seong-In Jeong, Seoul (KR); Sung-Jin Park, Pohang-si (KR); Dae-Sung Lee, Gwangju (KR)

(73) Assignee: POSCO, Pohang-Si (KR)

( * ) Notice: Subject to any disclaimer, the term of this patent is extended or adjusted under 35 U.S.C. 154(b) by 0 days.

(21) Appl. No.: 12/744,180

(22) PCT Filed: Jul. 14, 2008

(86) PCT No.: PCT/KR2008/004123

§ 371 (c)(1),
(2), (4) Date: May 21, 2010

(87) PCT Pub. No.: WO2009/082075

PCT Pub. Date: Jul. 2, 2009

(65) Prior Publication Data

US 2010/0243193 A1 Sep. 30, 2010

(30) Foreign Application Priority Data

Dec. 21, 2007 (KR) ..... 10-2007-0135231

(51) Int. Cl.
*B22D 11/12* (2006.01)

(52) U.S. Cl. ..... 164/448; 164/418; 164/427

(58) Field of Classification Search ..... 164/448, 164/418, 427

See application file for complete search history.

(56) References Cited

U.S. PATENT DOCUMENTS 5,230,380 A * 7/1993 Sato ..... 164/418

FOREIGN PATENT DOCUMENTS

| | | | |
|---|---|---|---|
| JP | 63158583 A | * | 7/1988 |
| JP | 64-066049 | | 3/1989 |
| JP | 03-118945 | | 5/1991 |
| JP | 06-126390 | | 5/1994 |
| KR | 1020000040949 A | | 7/2000 |

OTHER PUBLICATIONS

International Preliminary Report on Patentability dated Jun. 22, 2010, including the Written Opinion of the International Searching Authority dated Jan. 9, 2009, for International Patent Application No. PCT/KR2008/004123, filed Jul. 14, 2008 (6 pages).

* cited by examiner

*Primary Examiner* — Nicholas D'Aniello
(74) *Attorney, Agent, or Firm* — Finnegan Henderson Farabow Garrett & Dunner LLP

(57) ABSTRACT

The present invention provides a casting roll of a twin-roll strip caster, including: a nickel plating layer formed on an outer circumferential surface and an end surface of the casting roll; a nickel-boron alloy plating layer formed on the nickel plating layer located on the end surface of the casting roll; and a hard plating layer formed on the nickel plating layer located on the outer circumferential surface of the casting roll and an outer circumferential surface of the nickel-boron alloy plating layer located on the end surface of the casting roll. The present invention improves durability of the casting roll.

2 Claims, 3 Drawing Sheets

【Fig. 1】
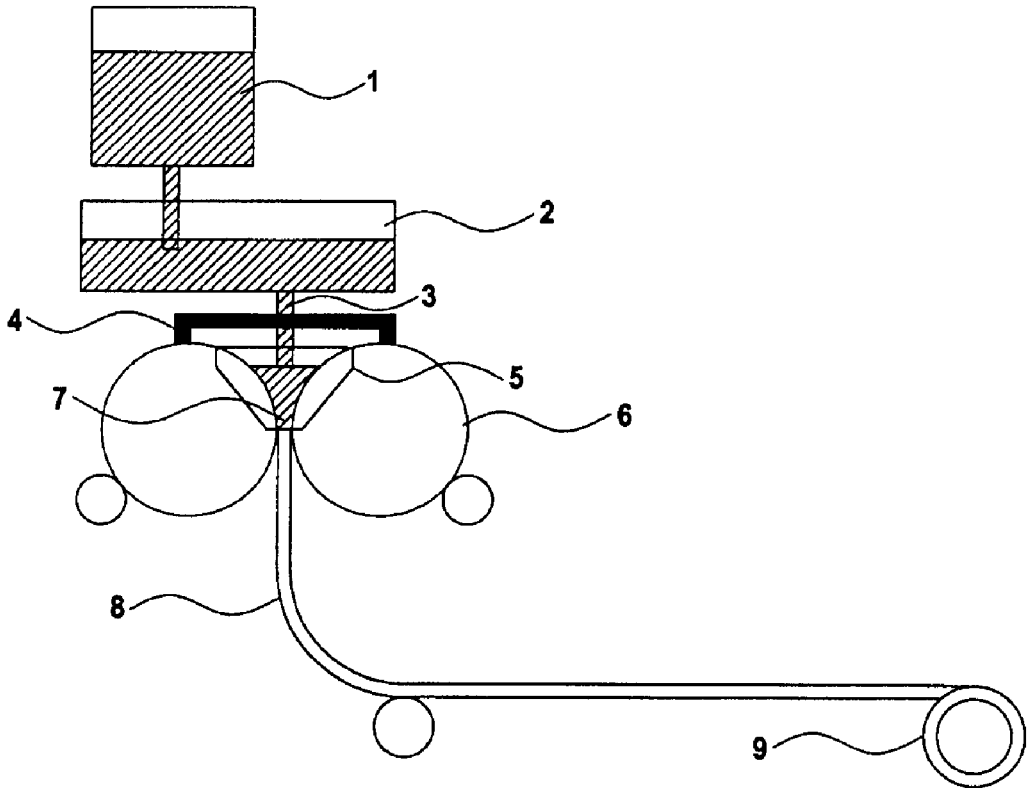
【Fig. 2】
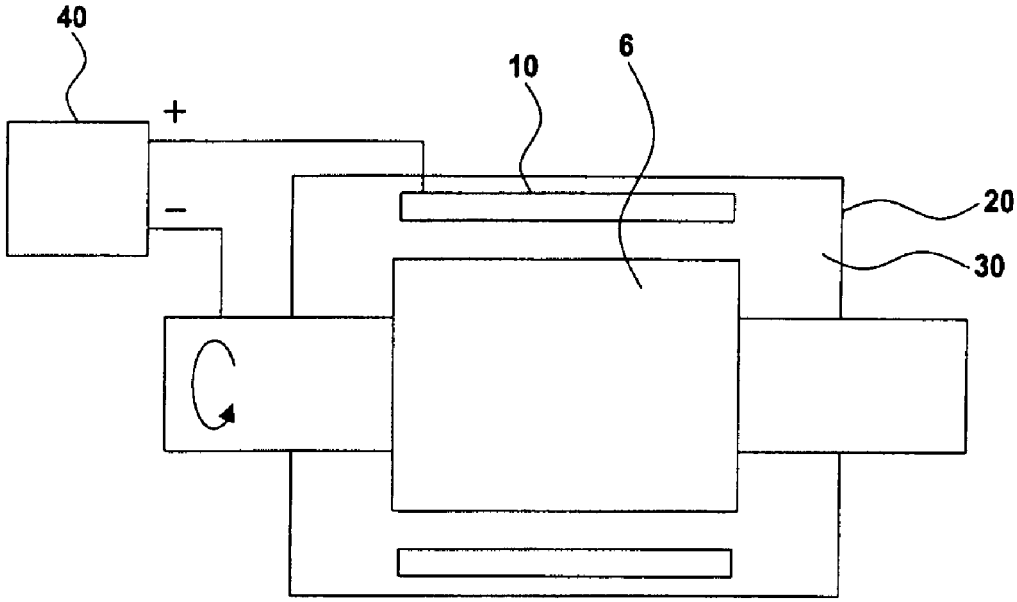

【Fig. 3】
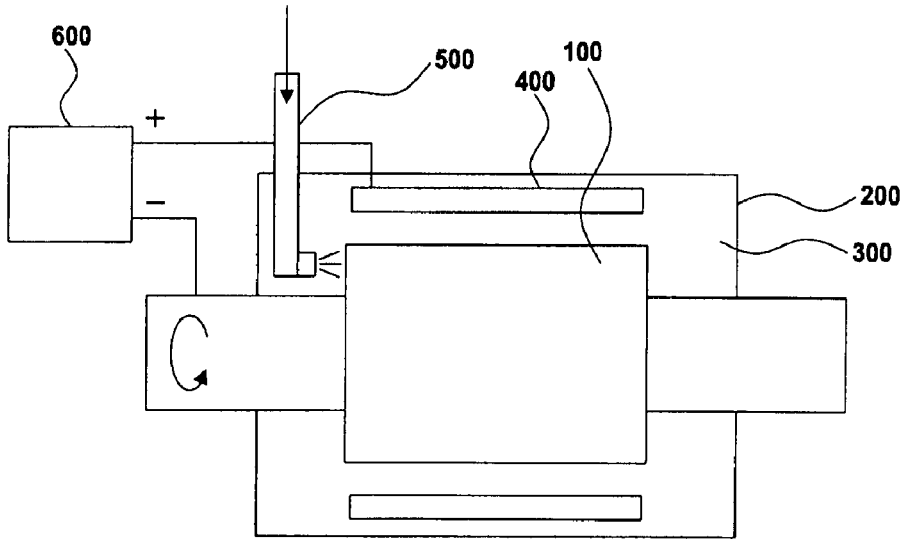
【Fig. 4】
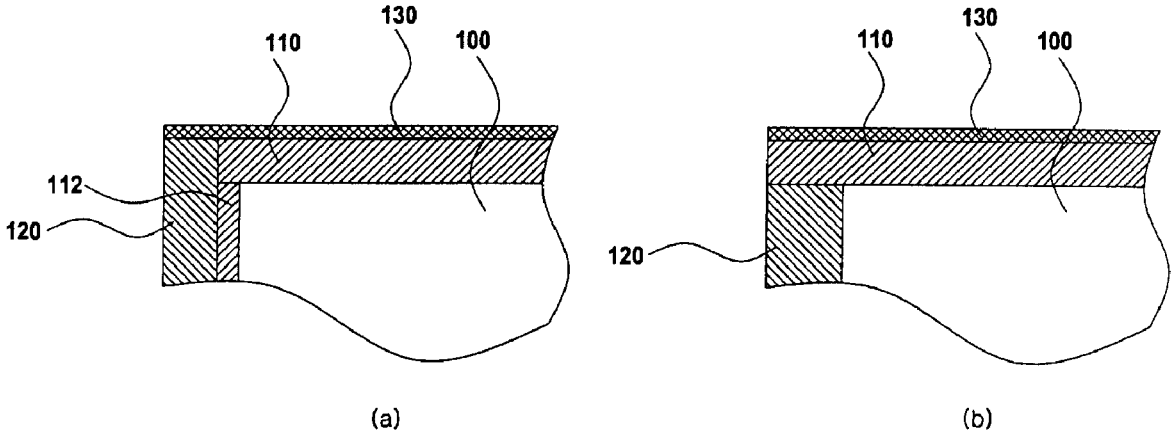

【Fig. 5】
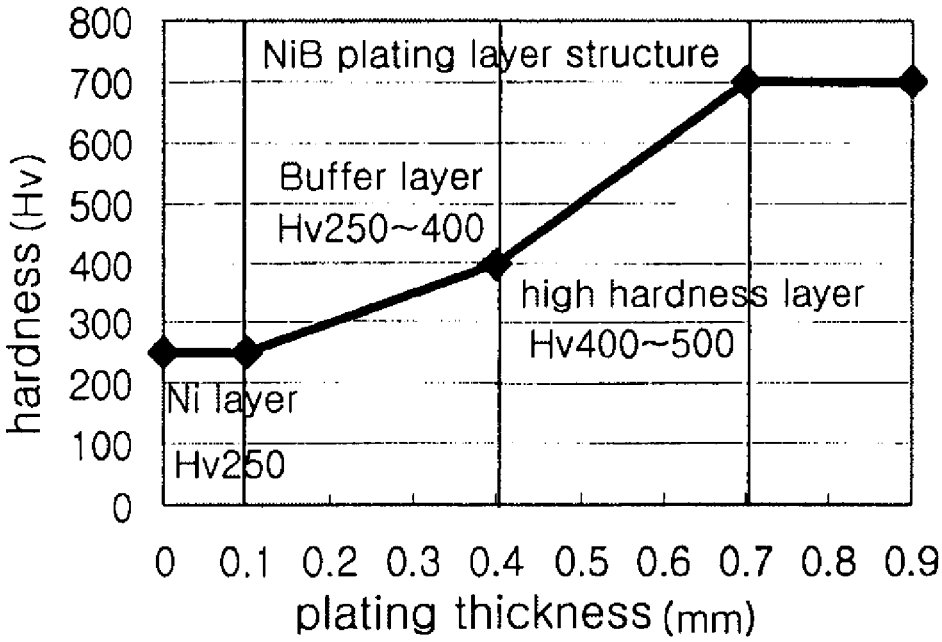
(a)
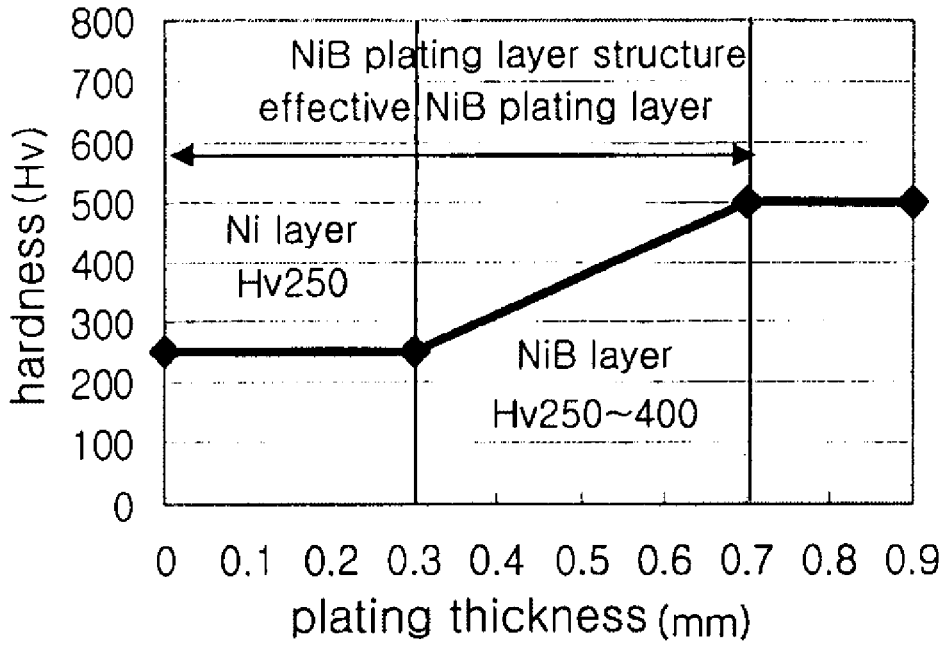
(b)

CASTING ROLL OF TWIN ROLL TYPE STRIP CASTER AND SURFACE TREATMENT METHOD THEREOF

TECHNICAL FIELD

The present invention relates to a casting roll of a twin-roll strip caster and a method of surface-treating the same, and, more particularly, to a casting roll of a twin-roll strip caster, in which a nickel-boron (Ni—B) alloy plating layer having high hardness and suitable thickness is formed on the end surface of the casting roll, the end surface thereof is being brought into contact with refractories, thus improving durability, and to a method of surface-treating the same.

BACKGROUND ART

As shown in FIG. 1, generally, in a method of forming a strip using a twin-roll strip caster, molten steel stored in a ladle 1 is introduced into a tundish 2, and is then fed to a space between edge dams 5 provided at both ends of casting rolls 6, that is, a space between the casting rolls 6, through an injection nozzle 3 to start solidification. In this case, a meniscus shield 4 is installed over the casting rolls 6 to protect the molten steel pool and prevent the oxidation of the molten steel. Subsequently, the molten steel is formed into a strip 8 while passing through a roll gap 7 between the casting rolls 6, and then the strip 8 is drawn, cooled, and then wound by a winder 9.

As such, in the method of forming molten steel into a strip having a thickness of 10 mm or less using a twin-roll strip caster, it is important that molten steel rapidly passes between the water-cooled casting rolls 6 rotating in directions opposite to each other through the injection nozzle 3, and thus a non-cracked strip having a desired thickness may be produced in high yield.

Meanwhile, the surface of a continuous casting mold is treated using an electrolytic plating method. As shown in FIG. 2, a casting roll 6, which is a subject to plating, is connected to a cathode, and a metal 10, which is used to plate the subject, is connected to an anode. Thereafter, the subject is completely immersed into a plating solution containing the plating metal, and then electric current is applied to this system, thereby obtaining a plating layer having a desired thickness.

In this case, the casting roll 6, which is the subject to plating, is rotated in order to improve plating quality, and, if it is flat, a plating solution is rotated to form a uniform plating layer. In this case, primarily, a nickel plating layer is formed on a copper plate, and secondarily, a nickel-tungsten (Ni—W) plating layer, a nickel-cobalt (Ni—Co) plating layer, which is a high-hardness plating layer, or the like is formed thereon to improve durability.

In this conventional method of plating a mold, nickel (Ni) is chiefly used, and, in relation to plating conditions, such as current density, temperature of a plating solution, and the like, the following technologies are disclosed.

Japanese Unexamined Patent Application Publication No. 1998-066049 discloses a technology for improving the durability of a casting roll by spray-coating the end surface of the casting roll. Japanese Unexamined Patent Application Publication No. 1989-254357 discloses a technology for improving the durability and quality of a mold by primarily forming a nickel (Ni) plating layer on the surface of the mold and then secondarily forming a chromium (Cr) plating layer on the nickel (Ni) plating layer. Japanese Unexamined Patent Application Publication No. 1990-047890 discloses a technology for improving the quality of a mold by forming a nickel (Ni) plating layer on the surface of the mold and then decreasing a heat transfer coefficient through a graphite coating process and thus decreasing temperature variability. Japanese Unexamined Patent Application Publication No. 2001-205399 discloses a technology for improving the durability of a casting roll by primarily forming a nickel (Ni) plating layer on the casting roll and then secondarily forming a nickel-tungsten (Ni—W) plating layer, a nickel-cobalt (Ni—Co) plating layer or the like, which is a high-hardness plating layer, on the nickel (Ni) plating layer.

However, in these conventional technologies, basically, a nickel (Ni) plating layer is primarily formed, and then is secondarily hard-plated or spray-coated for protection. In particular, they are problematic in that since a hard plating layer has high hardness, but on the other hand, it has high internal stress, it is very sensitive to be cracked, and as a result it is limited in so far as its thickness must be thin, with the result that it cannot be easily applied to extremely worn portions of the subjects to be plated.

Therefore, due to the limitation of the thickness of the hard plating layer, there are problems in that the hard layer cannot be easily applied to the end surface of a casting roll, the end surface thereof being worn out by being brought into contact with the edge dam, and in that the durability of the casting roll is deteriorated.

Here, among reference numerals, which are not described, in FIG. 2, '20' is a plating bath, and '40' is a rectifier.

DISCLOSURE

Technical Problem

Accordingly, the present invention has been made keeping in mind the above problems occurring in the prior art, and an object of the present invention is to provide a casting roll of a twin-roll strip caster, in which a nickel-boron ally plating layer is formed on the end surface of the casting roll by spraying a boron solution on a nickel plating layer, so that a plating layer having sufficient thickness and high hardness can be formed, thereby improving the durability of the casting roll and stabilizing the quality of the surface of the casting roll, and a method of surface-treating the casting roll.

Technical Solution

In order to accomplish the above object, an aspect of the present invention provides a casting roll of a twin-roll strip caster, including: a nickel plating layer formed on an outer circumferential surface and an end surface of the casting roll; a nickel-boron alloy plating layer formed on the nickel plating layer located on the end surface of the casting roll; and a hard plating layer formed on the nickel plating layer located on the outer circumferential surface of the casting roll and an outer circumferential surface of the nickel-boron alloy plating layer located on the end surface of the casting roll.

Another aspect of the present invention provides a casting roll of a twin-roll strip caster, including: a nickel-boron alloy plating layer formed on an end surface of the casting roll; a nickel plating layer formed on an outer circumferential surface of the casting roll and an outer circumferential surface of the nickel-boron alloy plating layer located on the end surface of the casting roll; and a hard plating layer formed on the nickel plating layer.

In the casting roll, the nickel-boron alloy layer may have a thickness of 0.1~2.0 mm.

Further, the nickel-boron alloy layer may have a hardness of 300~1000 Hv.

Further, the hard plating layer may be made of Ni—W or Ni—Co.

Furthermore, an interface between the nickel plating layer and the hard plating layer is roll-crowned or roughened.

In order to accomplish the above object, a further aspect of the present invention provides a method of surface-treating a casting roll of a twin-roll strip caster, including: forming a nickel plating layer on an outer circumferential surface and an end surface of the casting roll through an electrolytic plating method; forming a nickel-boron alloy plating layer on the nickel plating layer located on the end surface of the casting roll by spraying a boron solution on the nickel plating layer while performing a nickel plating process to impregnate boron into the nickel plating layer; and forming a hard plating layer on the nickel plating layer located on the outer circumferential surface of the casting roll and an outer circumferential surface of the nickel-boron alloy plating layer located on the end surface of the casting roll.

A still further aspect of the present invention provides a method of surface-treating a casting roll of a twin-roll strip caster, including: forming a nickel-boron alloy plating layer on an end surface of the casting roll by spraying a boron solution thereon while performing an electroless nickel plating process thereon to impregnate boron into nickel; forming a nickel plating layer on an outer circumferential surface of the casting roll and an outer circumferential surface of the nickel-boron alloy plating layer located on the end surface of the casting roll by spraying a nickel solution thereon; and forming a hard plating layer on the nickel plating layer.

The method of surface-treating a casting roll of a twin-roll strip caster may further include: after the forming of the nickel plating layer, conducting roll crowning work and roughening work on the outer circumferential surface of the casting roll.

Advantageous Effects

According to the present invention, in relation to the surface treatment of a casting roll of a twin roll strip caster, a nickel-boron ally plating layer is formed on the end surface of the casting roll by spraying a boron solution on a nickel plating layer, so that a plating layer having sufficient thickness and high hardness can be formed, thereby improving the durability of the casting roll and the quality of the edge of the casting roll.

DESCRIPTION OF DRAWINGS

FIG. 1 is a schematic view showing a general strip casting process;

FIG. 2 is a schematic view showing a conventional apparatus for plating a casting roll;

FIG. 3 is a schematic view showing an apparatus for plating a casting roll according to an embodiment of the present invention;

FIG. 4 is sectional views showing plating layers according to an embodiment of the present invention; and FIG. 5 is graphs showing the hardness distributions of plating layers according to an embodiment of the present invention.

BEST MODE

Hereinafter, preferred embodiments of the present invention will be described in detail with reference to the attached drawings.

FIG. 3 is a schematic view showing an apparatus for plating a casting roll according to an embodiment of the present invention, FIG. 4 is sectional views showing plating layers according to an embodiment of the present invention, and FIG. 5 is graphs showing the hardness distributions of plating layers according to an embodiment of the present invention.

As shown in FIG. 3, an apparatus for plating a casting roll according to the present invention is substantially the same as the conventional apparatus for plating a casting roll of FIG. 2, except that a plating bath 200 charged with a plating solution 300 is additionally provided at one side thereof with a spray nozzle 500 for injecting a boron solution in order to plate the end surface of a casting roll 100.

Further, as in the conventional apparatus for plating a casting roll, the casting roll 100 is connected to a cathode having passed through a rectifier 600, and a metal 400 to be plated is connected to an anode having passed through the rectifier 600.

A method of plating a casting roll using this plating apparatus includes: (a) forming a nickel plating layer on both sides of a casting roll 100, (b) forming the nickel plating layer into a nickel(Ni)-boron(B) alloy plating layer by spraying a boron solution on the nickel plating layer during the step of forming the nickel plating layer, and (c) forming a hard plating layer on the cylindrical portion of the casting roll.

In this case, the nickel-boron alloy plating layer is formed by spraying a boron solution on the nickel plating layer for a predetermined time while forming the nickel plating layer and thus combining boron and nickel to make a boron-nickel alloy. The hardness of the plating layer is changed depending on the amount and rate of the sprayed boron.

Moreover, before the hard plating layer is formed, a roll crowning work and a roughening (dimpling) work are conducted on the surface of the cylindrical portion of the casting roll 100), thus improving quality.

As such, in the present invention, since the hardness of the plating layer, if necessary, can be controlled, it may not be limited to a specific range. The essential technical idea of the present invention is characterized in that a boron solution is sprayed on a nickel plating layer during a nickel plating process, and then boron is impregnated into the nickel plating layer, so that boron and nickel are alloyed, thereby increasing the hardness of the plating layer while increasing the thickness thereof.

The formation of the plating layers according to the present invention may be conducted in the forms of (a) and (b) of FIG. 4.

For example, referring to (a) of FIG. 4, first, nickel plating layers 110 and 112 are formed on the outer circumferential surface and end surface of the casting roll 100, respectively, and then a nickel-boron alloy plating layer 120 is formed on the nickel plating layer 112 formed on the end surface of the casting roll 100, and finally, a hard plating layer 130 is formed on the nickel plating layer 110 formed on the outer circumferential surface of the casting roll 100 and the nickel-boron alloy plating layer 120.

In this case, it is preferred that prior to the formation of the hard plating layer 130, a roll crowning work and a roughening (dimpling) work be conducted on the outer circumferential surface of the casting roll 100.

As described in the background art, the hard plating layer 130 is chiefly made of nickel-tungsten (Ni—W) or nickel-cobalt (Ni—Co).

However, even if the plating layer structure shown in (a) of FIG. 4 is a stable structure in which the end surface of the casting roll 100 is securely supported, when a force is excessively applied to the nickel-boron alloy plating layer 120 located at an edge of the casting roll 100, the nickel-boron alloy plating layer 120 may be peeled off and damaged. Therefore, it is preferred that the plating layer structure shown in (a) of FIG. 4 be selectively used depending on process characteristics in combination with another embodiment of the present invention, described below.

That is, as another embodiment of the present invention, referring to (b) of FIG. 4, first, a nickel-boron alloy plating layer 120 is formed on the end surfaced of the casting roll 100, and then a nickel plating layer 110 is formed on the outer circumferential surface of the casting roll 100 and a part of the nickel-boron alloy plating layer 120, and finally, a hard plating layer 130 is formed on the nickel plating layer 110.

Even in this case, it is preferred that prior to the formation of the hard plating layer 130, a roll crowning work and a roughening (dimpling) work be conducted on the outer circumferential surface of the casting roll 100.

In this plating layer structure shown in (b) of FIG. 4, although the nickel plating layer 110 serves to resist the force applied to the nickel-boron alloy plating layer 120 formed on the edge of the casting roll 100, it is possible to deteriorate the wear-resistance of the edge of the casting roll 100.

Hereinafter, Examples of the present invention will be described in more detail.

Section (a) of FIG. 5 is a graph showing a plating layer structure in which the thickness of a nickel plating layer is minimized and a two-stage nickel-boron alloy plating layer is formed, thereby maximizing the hardness of the outermost plating layer, and section (b) of FIG. 5 is a graph showing a plating layer structure in which a nickel plating layer is thickly formed, and then a one-stage nickel boron alloy plating layer is formed, so that a stable plating layer can be formed even though its hardness is relatively low.

In the case when the hardness of the nickel-boron alloy plating layer is 300~1000 Hv, the nickel-boron alloy plating layer exhibits excellent stability. When the hardness of the nickel-boron alloy plating layer is below 300 Hv, it is easily worn, and when the hardness of thereof is above 1000 Hv, it becomes easily cracked and peeled. Therefore, it can be seen that it is preferred that the hardness of the nickel-boron alloy plating layer be in the above range.

Further, the thickness of the nickel plating layer may be in the range mentioned in the background art. However, it is preferred that the thickness of the nickel-boron alloy plating layer be 0.1~2.0 mm. When the thickness of the nickel-boron alloy plating layer is less than 0.1 mm, it is difficult to form a nickel-boron alloy plating layer having desired performance, and when the thickness thereof is more than 2.0 mm, it is easily cracked and peeled. Therefore, the thickness of the nickel-boron alloy plating layer must be in the above range.

Further, in the process of forming a hard plating layer, since the roughness of the hard plating layer must be maintained even after roughening work is performed, if possible, a hard plating layer having low thickness and high hardness is required. Therefore, it is preferred that the hard plating layer be a Ni—W or Ni—Co plating layer as described above.

According to the present invention, it can be seen that the durability and quality of a casting roll can be improved, and that the quality of the edge and surface of a casting roll can also be improved.

The invention claimed is:

1. A casting roll of a twin-roll strip caster, comprising:

a nickel plating layer formed on an outer longitudinal circumferential surface and an end surface of the casting roll through an electrolytic plating method;

a nickel-boron alloy plating layer having a thickness of 0.1~2.0 mm and a hardness of 300~1000 Hv formed on the nickel plating layer located on the end surface of the casting roll by spraying a boron solution on the nickel plating layer while performing a nickel plating process to impregnate boron into the nickel plating layer;

a roll crown and roughness formed on the outer longitudinal circumferential surface of the casting roll; and a hard plating layer of Ni—W or Ni—Co formed on the nickel plating layer located on the outer longitudinal circumferential surface of the casting roll and an outer circumferential surface of the nickel-boron alloy plating layer located on the end surface of the casting roll wherein the end surface is substantially perpendicular to the outer longitudinal circumferential surface.

2. A method of surface-treating a casting roll of a twin-roll strip caster, comprising:

forming a nickel plating layer on an outer longitudinal circumferential surface and an end surface of the casting roll through an electrolytic plating method;

forming a nickel-boron alloy plating layer having a thickness of 0.1~2.0 mm and a hardness of 300~1000 Hv on the nickel plating layer located on the end surface of the casting roll by spraying a boron solution on the nickel plating layer while performing a nickel plating process to impregnate boron into the nickel plating layer; forming a roll crown and roughness on the outer longitudinal circumferential surface of the casting roll; and forming a hard plating layer of Ni—W or Ni—Co on the nickel plating layer located on the outer longitudinal circumferential surface of the casting roll and an outer circumferential surface of the nickel-boron alloy plating layer located on the end surface of the casting roll wherein the end surface is substantially perpendicular to the outer longitudinal circumferential surface.

* * * * *